US008443521B2

(12) United States Patent
Klecker

(10) Patent No.: US 8,443,521 B2
(45) Date of Patent: May 21, 2013

(54) LOCKABLE FOLDING KNIFE

(76) Inventor: Glenn Klecker, Silverton, OR (US)

( * ) Notice: Subject to any disclaimer, the term of this patent is extended or adjusted under 35 U.S.C. 154(b) by 210 days.

(21) Appl. No.: 12/927,474

(22) Filed: Nov. 15, 2010

(65) Prior Publication Data

US 2011/0119926 A1 May 26, 2011

Related U.S. Application Data

(60) Provisional application No. 61/264,616, filed on Nov. 25, 2009.

(51) Int. Cl.
*B26B 1/02* (2006.01)
*B26B 1/04* (2006.01)

(52) U.S. Cl.
USPC ..... 30/155; 30/161

(58) Field of Classification Search
USPC ..... 30/153, 155–161; D8/95–100
See application file for complete search history.

(56) References Cited

U.S. PATENT DOCUMENTS

| | | | | | |
|---|---|---|---|---|---|
| 240,749 | A | * | 4/1881 | Miller | 30/155 |
| 254,404 | A | * | 2/1882 | Story | 30/155 |
| 304,141 | A | * | 8/1884 | Smith | 30/155 |
| 702,967 | A | * | 6/1902 | Kinney | 30/155 |
| 702,968 | A | * | 6/1902 | Kinney | 30/155 |
| 1,179,111 | A | * | 4/1916 | Knowlton | 30/155 |
| 1,248,852 | A | * | 12/1917 | Hemming | 30/157 |
| 1,365,487 | A | * | 1/1921 | Hallvarson | 30/155 |
| 1,372,807 | A | * | 3/1921 | Gallinek | 30/161 |
| 1,600,602 | A | * | 9/1926 | Schrade | 30/155 |
| 1,667,462 | A | * | 4/1928 | Logan | 30/156 |
| 1,808,239 | A | * | 6/1931 | Logan | 30/157 |
| 1,841,241 | A | * | 1/1932 | Deppmeyer | 30/155 |
| 2,798,290 | A | * | 7/1957 | Bassett | 30/161 |
| 3,699,654 | A | * | 10/1972 | Gerling | 30/155 |
| 4,354,313 | A | | 10/1982 | Naifeh | |
| 4,773,159 | A | * | 9/1988 | Casazza, Jr. | 30/155 |
| 5,060,379 | A | | 10/1991 | Neely | |
| D321,820 | S | * | 11/1991 | Russell | D8/99 |
| 5,515,610 | A | * | 5/1996 | Levin et al. | 30/161 |
| D411,091 | S | * | 6/1999 | Halligan | D8/99 |
| D414,671 | S | * | 10/1999 | Halligan | D8/99 |
| 6,038,735 | A | * | 3/2000 | Chang | 30/153 |
| D427,043 | S | * | 6/2000 | Cheng | D8/99 |
| D429,986 | S | * | 8/2000 | Cheng | D8/99 |
| 6,101,722 | A | * | 8/2000 | Cheng | 30/155 |
| 6,101,724 | A | | 8/2000 | Halligan | |
| 6,112,352 | A | | 9/2000 | Legg | |
| 6,289,592 | B1 | * | 9/2001 | Emerson | 30/161 |
| 6,675,484 | B2 | * | 1/2004 | McHenry et al. | 30/161 |
| 6,732,436 | B2 | | 5/2004 | Moizis | |

(Continued)

*Primary Examiner* — Jason Daniel Prone
(74) *Attorney, Agent, or Firm* — Robert J. Ireland

(57) ABSTRACT

A folding lock back knife apparatus includes a blade having a tip and a tang portion pivotally connecting to a handle of unitary construction formed from a continuous piece of metal having an integral locking mechanism and integral locking end portion, the locking end portion proximal to the pivot hole positioned to stop the blade from pivoting past the open position and the locking mechanism having a locking bar integral with a support arm continuously formed between a locking end portion and a pressure pad end constructed and arranged to lock the blade in relation to the handle when the locking end portion engages the at least one tang notch and unlocks the blade in relation to the handle when force is applied to the pressure pad end in the direction of the handle flexing the support arm, thereby disengaging the locking end portion from the tang notch.

9 Claims, 15 Drawing Sheets

U.S. PATENT DOCUMENTS

| | | | | |
|---|---|---|---|---|
| 6,751,868 | B2 | 6/2004 | Glesser | |
| D492,568 | S * | 7/2004 | Allen | D8/99 |
| D496,846 | S * | 10/2004 | Rivera et al. | D8/107 |
| D496,847 | S * | 10/2004 | Rivera et al. | D8/107 |
| D497,093 | S * | 10/2004 | Rivera et al. | D8/107 |
| D497,094 | S * | 10/2004 | Rivera et al. | D8/107 |
| D497,095 | S * | 10/2004 | Rivera et al. | D8/107 |
| D497,096 | S * | 10/2004 | Rivera et al. | D8/107 |
| 6,804,887 | B2 | 10/2004 | Cheng | |
| D497,791 | S * | 11/2004 | Rivera et al. | D8/107 |
| D501,127 | S * | 1/2005 | Rivera et al. | D8/107 |
| D530,180 | S | 10/2006 | Klecker et al. | |
| D533,043 | S | 12/2006 | Knight et al. | |
| D543,432 | S * | 5/2007 | Rivera et al. | D8/107 |
| 7,337,486 | B2 | 3/2008 | Tsuda et al. | |
| D571,181 | S | 6/2008 | Klecker et al. | |
| 7,536,788 | B2 | 5/2009 | VanHoy et al. | |
| D605,021 | S * | 12/2009 | Noraker | D8/99 |
| D605,022 | S * | 12/2009 | Noraker | D8/99 |
| 7,676,931 | B2 | 3/2010 | Knight et al. | |
| 7,712,399 | B2 | 5/2010 | Nenadic | |
| 7,721,448 | B2 | 5/2010 | Kao | |
| 7,752,759 | B2 * | 7/2010 | Perreault | 30/161 |
| 7,774,940 | B2 * | 8/2010 | Frank | 30/161 |
| 8,001,693 | B2 * | 8/2011 | Onion | 30/155 |
| D664,826 | S * | 8/2012 | Lebeau | D8/99 |
| D664,827 | S * | 8/2012 | Lebeau | D8/99 |
| 8,307,555 | B2 * | 11/2012 | Onion | 30/155 |
| 2003/0140500 | A1 * | 7/2003 | Cheng | 30/159 |
| 2004/0064953 | A1 * | 4/2004 | Cheng | 30/161 |
| 2004/0078981 | A1 * | 4/2004 | Cheng | 30/161 |
| 2007/0056169 | A1 * | 3/2007 | Cheng | 30/153 |
| 2008/0052913 | A1 * | 3/2008 | Cheng | 30/157 |
| 2009/0241348 | A1 * | 10/2009 | Westerfield | 30/161 |
| 2010/0313427 | A1 * | 12/2010 | Hsu | 30/161 |

* cited by examiner

LOCKABLE FOLDING KNIFE

CROSS REFERENCE TO RELATED APPLICATION

The present application claims the benefit of U.S. provisional Application No. 61/264,616 filed on Nov. 25, 2009 which is incorporated herein by reference.

FIELD

The present disclosure relates generally to a foldable knife, and in particular a foldable lock back knife benefiting from a handle of unitary construction having an integral locking mechanism for locking the blade in relation to the handle.

BACKGROUND

The conventional lockable folding knife has as many forms as there are applications. Locking knives of various types have been utilized throughout the prior art in a lockable folding arrangement having different types of locking mechanisms fixated or attached to their handle. The lock back mechanism is one of the simplest and most reliable. In practice, the lock back mechanism includes a locking bar substantially parallel to the handle of the knife with one end aligned over the upper back or rear tang of the blade. The locking bar is usually fixated as a separate part to the handle with weld, or through pin. As the blade rotates to the open position, the locking bar rides along the rear tang with spring tension, until the locking bar engages a notch in the rear tang, locking the blade in the open position. To unlock, the opposing end of the locking bar is depressed pivoting the locking bar out of the notch and away from the rear tang allowing the blade to close.

The commonly available lock back knife has a blade, a pivot pin, a handle, and a locking mechanism. The locking mechanism, having in its simplest form, individual components such as a locking bar, pins, springs and a bolster between the two halves of the handle that all require assembly within the handle during the manufacturing process.

Other methods of locking a knife requiring a plurality of components are known in the art. An example of one alternative method is a locking liner as taught by inventor Ed Halligan in U.S. Pat. No. 6,101,724. The handle has an integral locking bar formed from the same metal as the handle and arranged to exert side forces on the side of the blade as it opens causing wear, and in gritty environments excessive wear. Tolerances for a liner lock design must be precise in order for it to work properly, whereas the tolerances for a lock back are not as critical. The lock back design takes more abuse, has less wear surface between the locking bar and the blade, and is easier and less expensive to manufacture making it the preferred design for a simple pocket knife. Further, the unlocking mechanism of #724 requires a side force applied from a direction perpendicular to the handle, and when the blade unlocks, the user's finger or thumb is aligned with the sharpened blade portion thereby exposing the user to a potential cut hazard.

There are many designs of lock back folding knives involving a plurality of necessary locking mechanism components, assembled in complex and compact handle configurations, but none achieve the reliable lock back function with the locking and unlocking mechanism being integral in the knife handle, constructed of a continuous piece of metal, requiring no additional components, no welds, or complex assembly.

SUMMARY

The present invention relates to a lockable folding knife having a lock back locking mechanism for engaging the blade securely in the open and closed positions wherein the locking mechanism is integral in the handle and of unitary construction. The user unlocks the knife by applying a force at the far end of the handle away from the sharpened blade, and in a direction towards the handle, making the unlocking of the knife safe, simple, and easily performed.

As used herein, the terms "integral" and "unitary construction" refers to a construction that does not include any welds, fasteners, or other means for securing separately formed pieces of material to each other. Although these methods can be used to simulate a unitary construction, they are not unitary because they require methods of joining that are weaker than the metal itself.

Further terms used herein include "Semipierced" as a technique used and known in the art of fine blanking, commonly also called cold extrusion. Another term used herein is "Blank" which refers to a piece of metal prepared to be made into something by a further operation.

The handle constructed from a continuous chunk or sheet of metal simplifies the manufacturing processes while eliminating the need for additional individual parts. The elegant unitary construction of the lockable folding knife is easily manufactured, simple to use, and as durable as the metal from which it is constructed.

The unitary construction for the preferred embodiment having a two sided handle is achieved in the production environment by the use of a progressive stamping die. At each station within the die, material is punched out of a flat blank leaving a large flat part that has a spine left intact on at least one end with substantially mirror image cutaways of the handle shape and locking mechanism on each side. After all the material is removed, the next station in the stamping die will typically fold down both of the mirror image sides simultaneously along the spine of the handle to ensure that they form evenly and that the pivot holes line up. The mirror image sides may be folded down individually in certain tooling circumstances. In the last stage the front and rear spine locations are sheared free and the finished handle drops out of the press.

In the one sided handle embodiment, the same process would apply excepting the spine portion that would be folded over being connected to one handle side only, rather than being in continuous metal communication with each side of the two sided handle embodiment.

Depending on manufacturing method, the locking mechanism may require an additional step to provide the desired resilient characteristics. For example, if the material is steel or other heat treatable material, the locking mechanism is heat treated after being deformed to the desired resilient position thereby creating a spring biased form without the need of adding a spring component. The desired resiliency force to unlock the blade is achieved through the heat treating process of the material used, or by modifying the thickness, cross section or the type of material of the support arm component.

The handle design is robust allowing construction from most metal materials including aluminum, steel and titanium.

DETAILED DESCRIPTION

Figure 6:
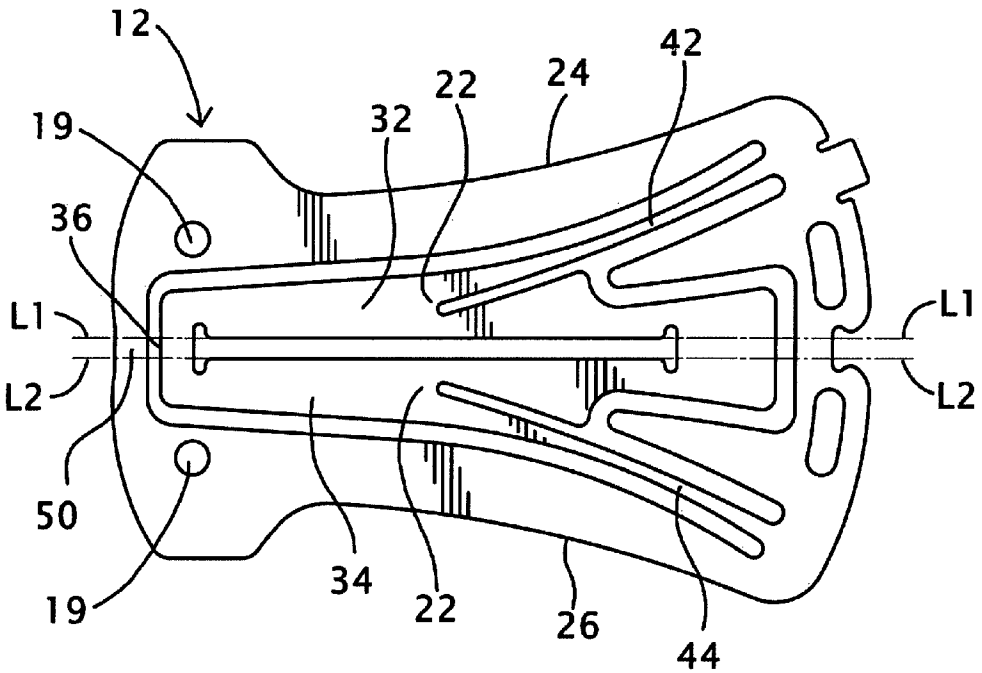
FIG. 6 is a top plain view of the handle blank for the knife shown in FIG. 1.

As used herein and defined before, the terms "integral" and "unitary construction" refers to a construction that does not include any welds, fasteners, or other means for securing separately formed pieces of material to each other. For example in FIG. 1, the locking mechanism 22 is integrally formed with the handle 12 and does not require any welds, fasteners, or other means to secure the locking mechanism to the handle. As shown in FIG. 6, the entire handle 12 with locking mechanism 22 is of unitary construction out of a single sheet of metal having the locking mechanism 22 integral in the handle 12.

Further terms used herein and defined above include "Semipierced" as shown and described in FIGS. 9-15. Also used is "Blank" referring to a piece of metal prepared to be made into something by a further operation.

Figure 1:
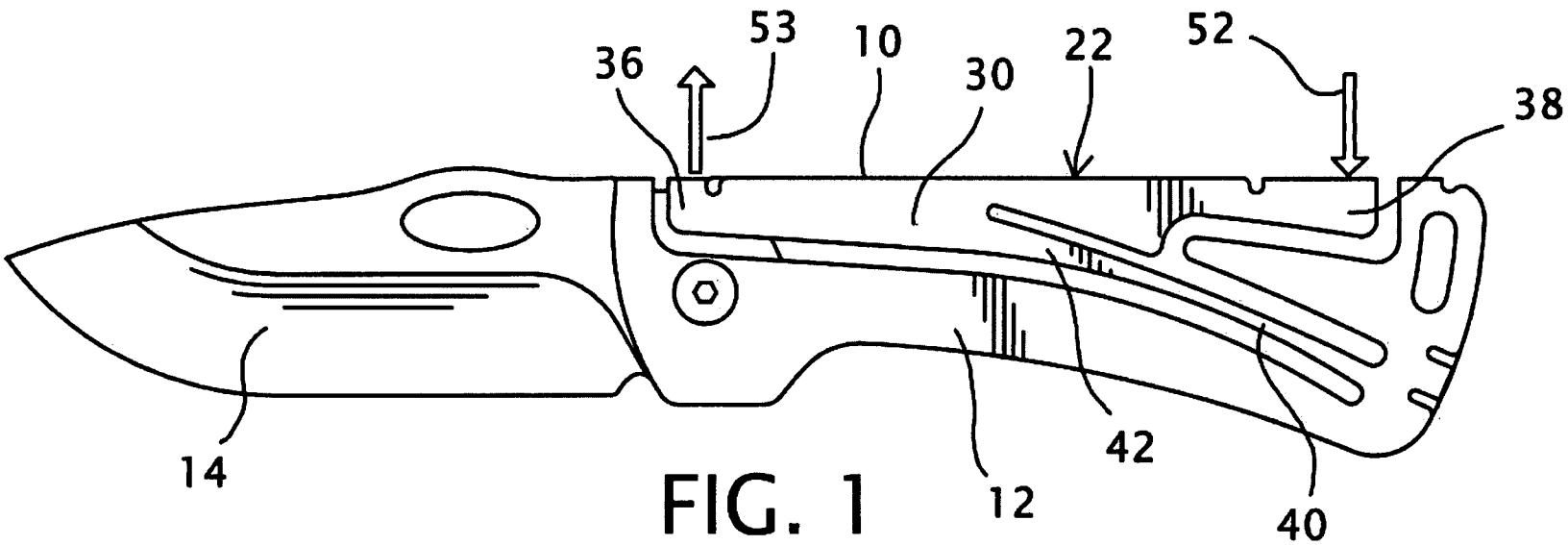
FIG. 1 is a side elevation view of one embodiment of the folding knife, shown with the blade in the locked open position.
Figure 2:
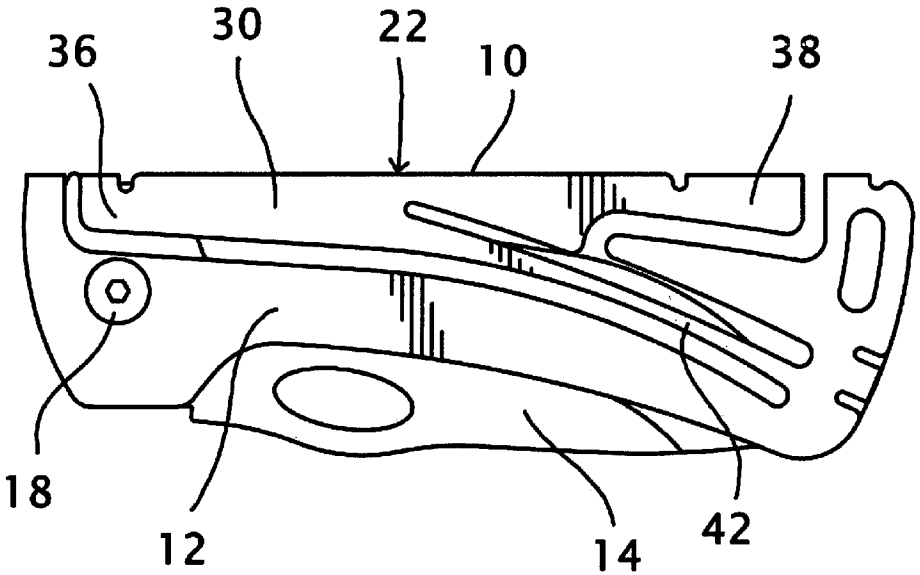
FIG. 2 is a side elevation view of a folding knife of FIG. 1, shown with the blade in the locked closed position.
Figure 3:
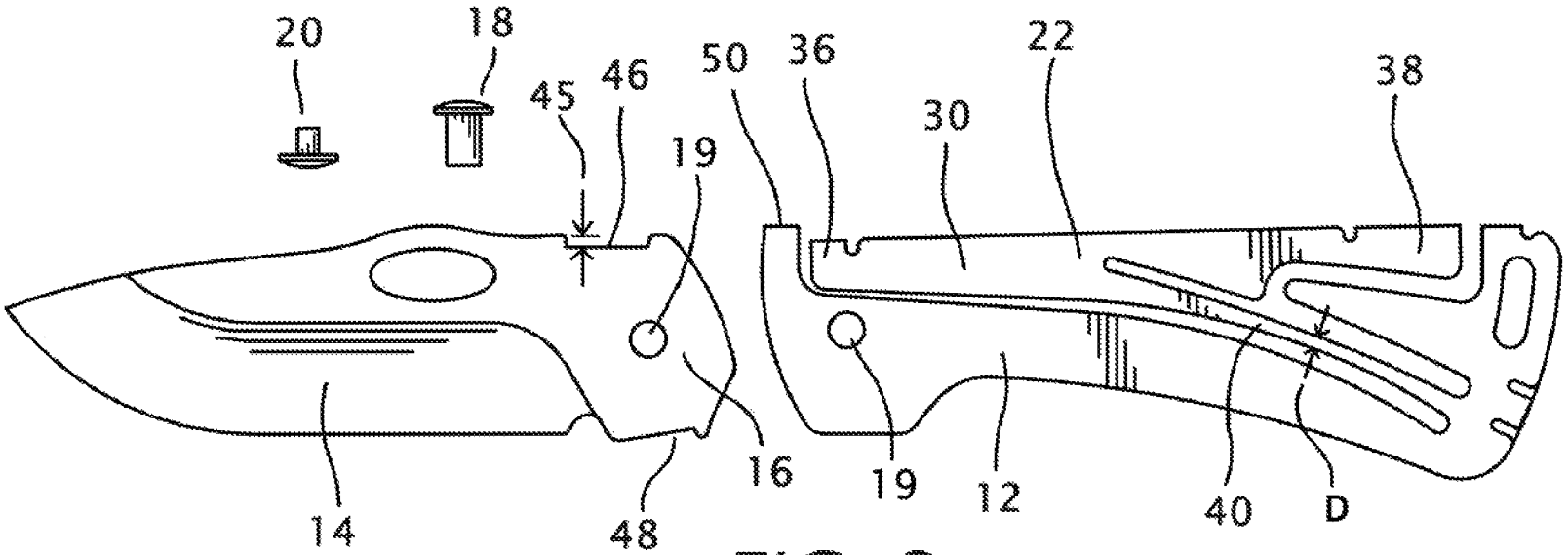
FIG. 3 is a side view showing the knife of FIG. 1 in a disassembled state.

In FIGS. 1 and 3 the knife 10 comprises a handle 12 and a knife blade 14 pivotably coupled to the handle 12 proximal to a tang portion 16 of the blade. The blade 14 is pivotable about a pivot axis between a closed, or folded, position as shown in FIG. 2 and an open position as shown in FIG. 1. The blade 14 can be pivotably coupled to the handle 12 by a pivot assembly comprising a pivot pin 18 extending through corresponding pivot holes 19 in the handle 12 and the blade 14 and a pivot screw 20 that extends through an opening in the opposite side of the handle 12 and is tightened into an internally threaded opening in the pivot pin 18. The locking and unlocking of the blade 14 in relation to the handle 12 is performed by applying manual pressure 52 at the to the locking bar 30 at pressure pad end 38 in the direction of the handle 12 thereby lifting the locking end portion 36 in direction 53 away from the blade 14 with the effective pivot point located within the support arm 40. What is meant by an effective pivot point is that the locking bar 30 flexes at the support arm 40 as if it was pivoting, but without a pivot structure.

Figure 4:
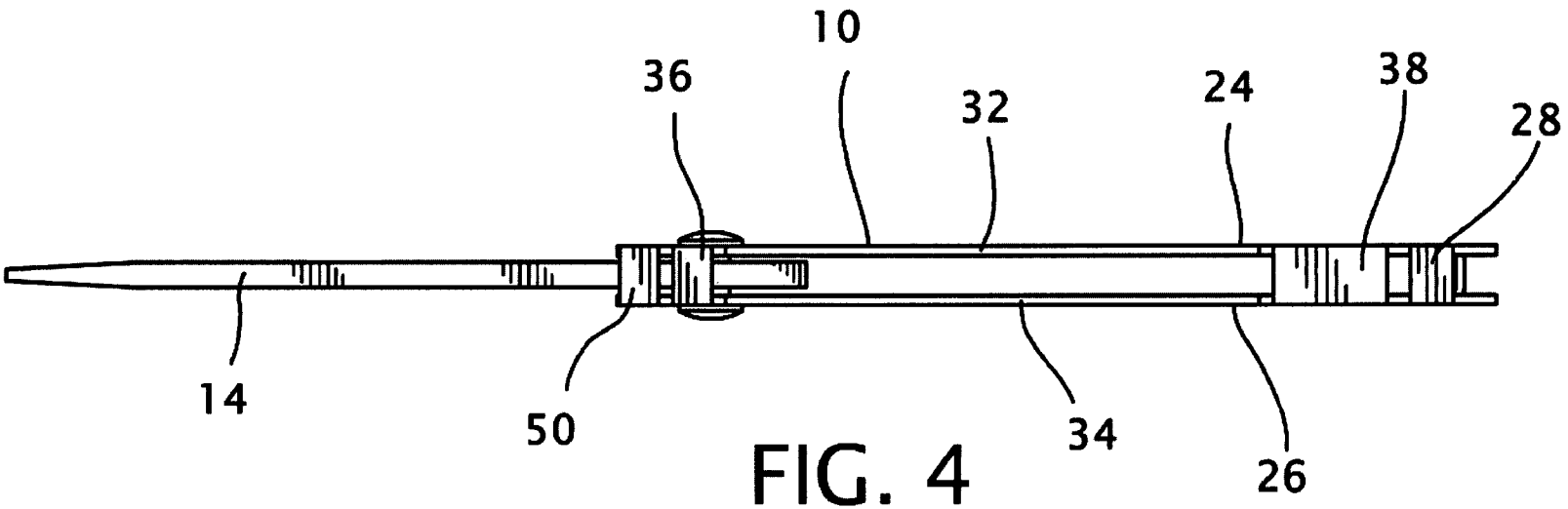
FIG. 4 is a top plain view of the folding knife of FIG. 1, shown with the blade in the locked open position.

Referring to FIGS. 1-6, the knife 10 includes a lock back type locking mechanism 22 for retaining the blade in the closed position as shown in FIG. 2, and the open position as shown in FIGS. 1 and 4. The locking mechanism 22 is formed integrally with the handle 12 such that the handle 12 and the locking mechanism 22 have a unitary construction.

FIG. 1 illustrates how to easily and safely unlock and close the blade with manual pressure 52 as applied downwardly towards the handle 12 at the pressure pad end 38 of the locking bar 30 as shown by the direction of arrow of manual pressure 52, which causes the locking bar 30 to effectively pivot and the locking end portion 36 to lift up in direction 53 away from the handle 12 and out of the first tang notch 46 when engaged in the open position with the blade. Pushing down on the pressure pad end 38 of the locking bar 30 in this manner described above causes the support arm 40 to flex or deflect slightly, causing the locking end portion 36 to move in direction 53 thereby lifting the locking end portion 36 out of the notch 46 shown in FIG. 3. When the locking end portion 36 is clear of the rear upper edge 54 (FIG. 5) of the notch 46, the blade 14 can be pivoted to the closed position shown in FIG. 2 thereby closing the knife 10.

In FIG. 2 the blade 14 is pivoted closed, the locking end portion 36 can ride against the rear edge 56 of the tang until the bias of the support arm 30 forces the locking end portion 36 into the second tang notch 48 in the blade 14 thereby defining the closed position, and lockingly securing the blade 14 in the closed position.

As illustrated in FIG. 2, the bias of the support arm 40 desirably is strong enough to retain the blade in the closed position against the weight of the blade. The second tang notch 48 can be formed with an angled rear surface 58 that functions as a cam surface that allows the blade to be opened against the biasing force of the locking bar without applying manual pressure to the pressure pad end 38 of the locking bar. As the blade pivots away from the closed position, the locking end portion 36 slides along the cam surface 58 and the rear surface 56 of the tang and is then forced into engagement with the first tang notch 46 when the blade 14 reaches the fully open position shown in FIG. 1.

FIG. 3 illustrates the disassembled view showing the locking mechanism 22 consisting of a locking bar 30 having a locking end portion 36 proximal to the pivot structure (consisting of a pivot pin 18 and screw 20), and a pressure pad end 38 all formed in continuous metal having the support arm 40 resiliently biased and in metal communication with the handle 12. FIG. 3 demonstrates the resilient bias of the locking bar 30 in its final form after heat treating but before being assembled. The support arm 40 is bent down and the pressure pad end 38 is slightly raised. The support arm 40 is cut out of the same continuous metal as the handle 12 in adequate thickness and width to provide desired resiliency and manual pressure at the locking end portion 36, while not being too rigid or stiff for a user to depress the pressure pad end 38. The notch depth 45 of the first tang notch 46 can be made deeper or shallower depending on desired locking strength, thickness of material, or handle 12 configuration.

As shown in the illustrated embodiments of FIGS. 1-4, the desired resiliency or spring like characteristics of the support arm 40 may be achieved by constructing the handle 12 from a thicker or thinner sheet of metal. The thickness of the sheet of metal used to construct the handle 12 for a one inch or larger knife must be at least forty thousandths (0.040 inches) or the support arm 40 may prematurely fails due to metal fatigue under extreme conditions. The thicker the metal sheet out of which it's constructed, the thicker the support arm 40 thereby, improving the resiliency or spring like characteristics. Alternatively, as illustrated in FIG. 3, the arm depth D of the support arm 40 may also be increased thereby increasing resiliency and spring like characteristics. The support arm 40 may be further enhanced through common heat treatment techniques in order to achieve the desired force require to lock and unlock the knife.

The locking mechanism 22 is formed in the handle such that the locking end portion 36 of the locking bar 30 is resiliently biased against the cam surface of tang portion 16 of the blade 14 by the support arm 40 as shown in FIG. 3. In this manner, the support arm 40 serves as a spring that biases the locking bar against the blade tang. In the illustrated embodiment, each section 42, 44 of the support arm is a "side-loaded" leaf spring in that pressure is applied in a direction that is in the plane of the longitudinal side edges each section 42, 44. As discussed earlier the resiliency of the support arm 40 may be increased by heat treating or by modifying the profile of the arm's cross section.

Figure 5:
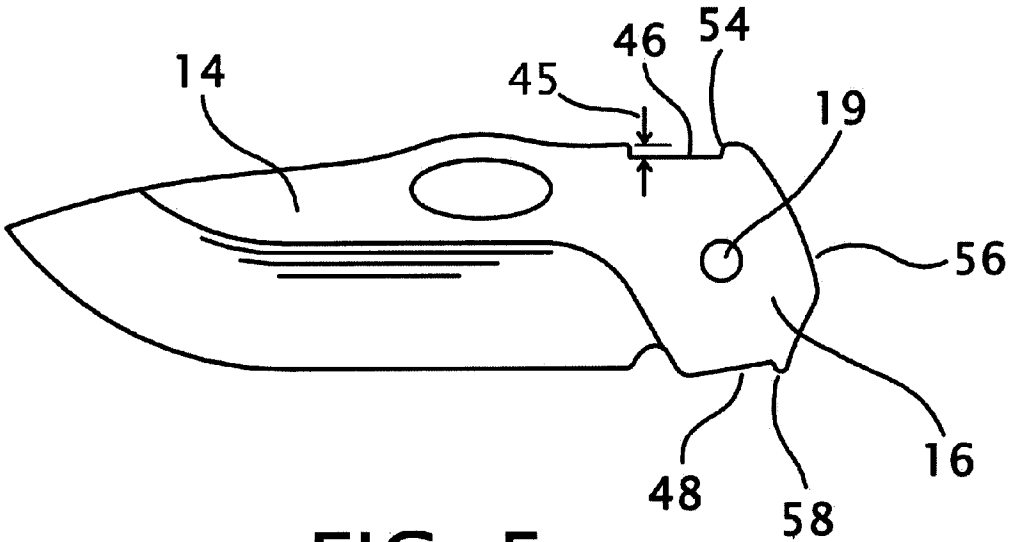
FIG. 5 is a side elevation view of the knife blade of FIG. 1.

In FIG. 5, the tang portion 16 is formed with a first tang notch 46 and a second tang notch 48. When the blade is in the open position as in FIG. 1, the locking end portion 36 resides in the first tang notch 46 of the blade to retain the blade in the open position during use against forces tending to close the blade. As shown in FIG. 4, the forward end portion 50 of the spine 28 also engages the first tang notch 46 forwardly of the locking end portion 36 and prevents pivoting of the blade past the open position (i.e., past the open position shown in FIG. 1 in the clockwise direction). The notch depth 45 may generally be of size matching the thickness of the metal sheet out of which the blank shown in FIG. 6 is cut, but it may also be more or less, depending on performance requirements.

The blank shown in FIG. 6 illustrates the handle 12 after being cut out into a blank but before being folded as shown in FIGS. 1-4. There is no limit on the maximum of thickness of the sheet of metal so long as the sheet of metal is foldable about the radius defined by the two longitudinal fold lines L1, L2. (for the two sided embodiment) without significant tearing along the fold line which can decrease the structural integrity of the material at the fold. As discussed in the summary and shown in FIGS. 6 and 9, the unitary construction of the handle 12 is accomplished by either starting with a sheet of continuous metal, or by starting with a chunk of metal and machining out the cutaway portions. The sheet metal being less expensive and easier to form is the preferred material for the handle 12. However, for some materials like titanium, aluminum and certain grades of steel, constructing from a chunk of material is the better option as common CNC machining procedures of cutting away the same portions as described in the sheet metal construction yield the same handle configurations. The knife handle 12 in disassembly as shown in FIG. 3 and in blank form in FIG. 6 having a support arm 40 of the locking mechanism 22 connects the locking bar 30 to the handle 12 and includes two laterally spaced-apart sections 42, 44 on opposite sides of the knife (as shown in FIG. 6). One section 42 is on the same side of the knife as and positioned below the first section 32 of the locking bar and the other section 44 is on the same side of the knife as and positioned below the second section 34 of the locking bar. The upper end of each section 42, 44 is attached to a corresponding section 32, 34 of the locking bar 30 at respective location intermediate to the locking end portion 36 and pressure pad end 38 of the locking bar (as shown in FIG. 6). The lower end of each section 42, 44 is attached to a corresponding side portions 24, 26 near the rear of the handle. At the forward end of the handle, the first and second side portions 24, 26 are joined by a forward end portion of spine 50.

The sheet metal constructions as demonstrated in FIG. 6 shows the handle 12 and locking mechanism 22 formed by stamping a handle blank from a sheet of metal and then bending the blank along two longitudinal fold lines L1, L2 to define first side portion 24, and second side portion 26, respectively, and an upper spine portion 28 of the handle 12 as shown in FIG. 4. The bottom of the handle opposite the upper spine portion 28 is open to allow the blade to be folded into the handle. The locking mechanism 22 includes an upper locking bar 30 defined by, in the illustrated embodiment, first and second sections 32, 34 (FIG. 4), respectively, on opposite sides of the handle. The first and second sections 32, 34 are joined to each other by a forward or locking end portion 36 of the locking bar 22 and by a pressure pad end 38.

Figure 7:
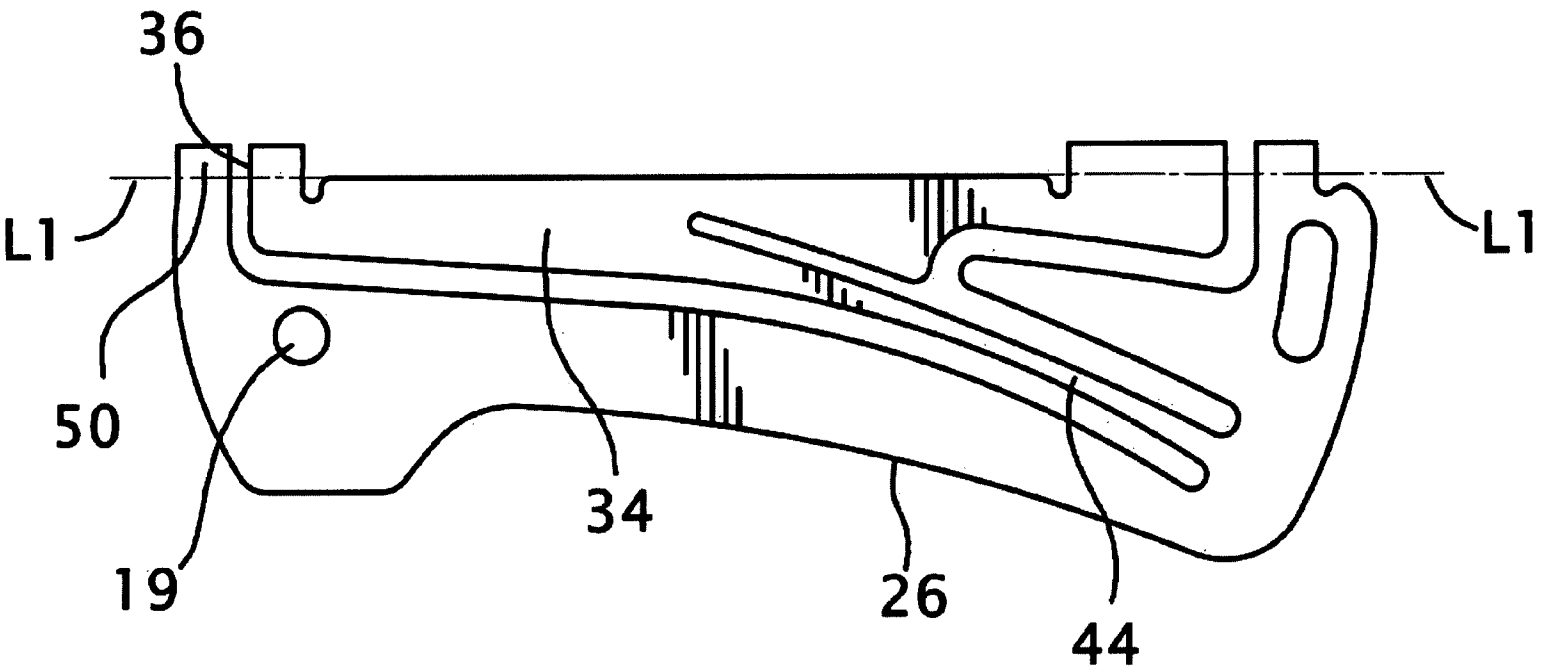
FIG. 7 is a side view of the handle blank of a one-sided handle embodiment of the folding knife of FIG. 1.
Figure 8:
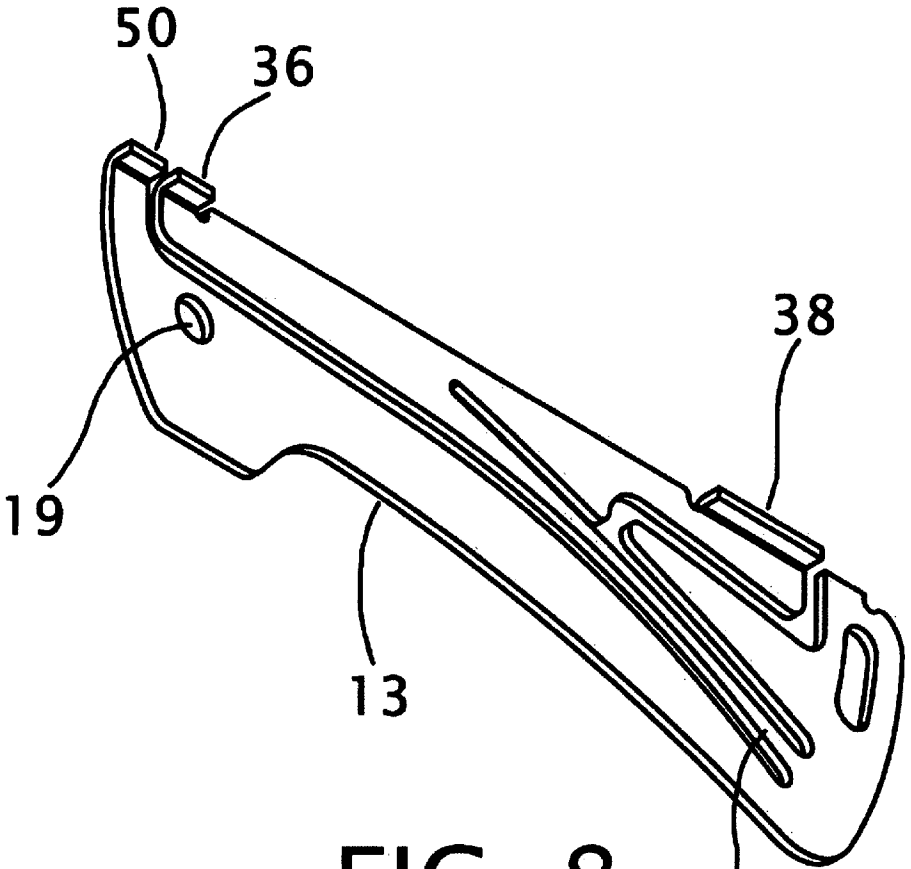
FIG. 8 is an elevated side view of the one-sided handle embodiment.

Shown in FIG. 7 in blank form and FIG. 8 after being folded is the one sided handle embodiment 13. The end portion of spine 50, the locking end portion 36, and the pressure pad end 38 are formed in the same way as described herein and shown in FIGS. 1-6, but with only one side handle 13 having the end portion of spine 50, the locking end portion 36, and the pressure pad end 38 formed with an approximate 90 degree bend as in relation to the one sided handle 13.

In the alternative embodiments shown in FIGS. 9-15, the knife consists of only two components, a blade, and a handle, without any additional parts, components, or other materials.

Figure 9:
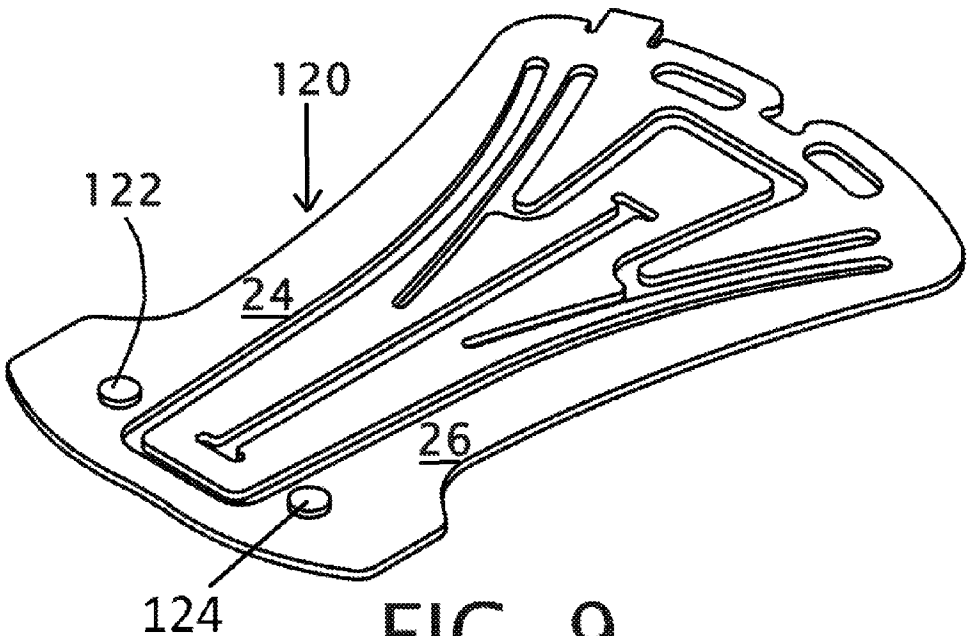
FIG. 9 is a perspective view of a handle blank for forming an alternate embodiment of the folding knife of FIG. 1 wherein the semi-piercing fine blanking technique is used to form the pivot structure.

FIG. 9 is perspective view of a handle 120 in blank form of an alternate embodiment having the pivot structure 17 integral to the handle consisting of a semi-pierced first pin 122 and a semi-pierced second pin 124. The handle 120 may have all of the features of and can be constructed in the same manner as the handle 12 as shown in FIGS. 1-8, with the pivot structure of pivot pin 18 and screw 20 replaced with the semi-pierced first pin 122 and semi-pierced second pin 124.

The advantage gained by utilizing the semi-pierced pivot structure to pivotally secure the blade 14 to the handle 12 shown and described in FIGS. 9-15 is the elimination of the pivot pin 18 and screw 20. The same fold over forming process in constructing the embodiment having the two sided handle 12 described herein and shown in FIGS. 1-6 above is still implemented, as illustrated in perspective in FIG. 10 and in partial fold shown from the end in FIG. 11, with the completed fold shown in FIG. 12.

Figure 10:
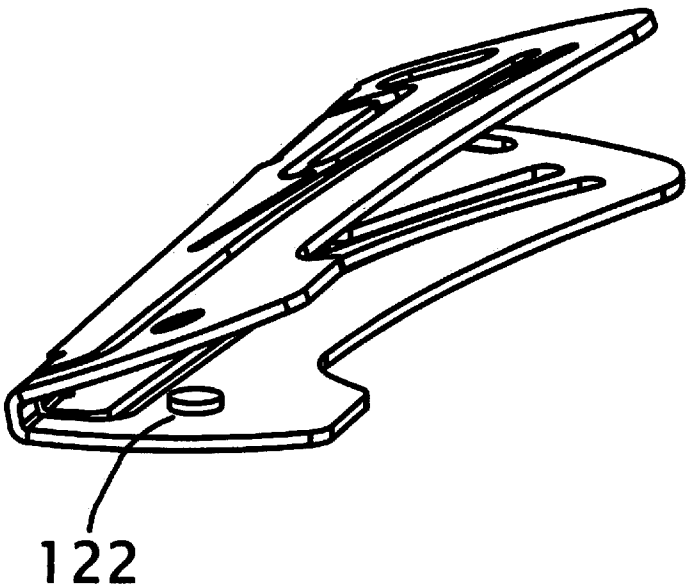
FIG. 10 is a perspective view of the semi-pierced embodiment of FIG. 9 in partial folded position.
Figure 11:
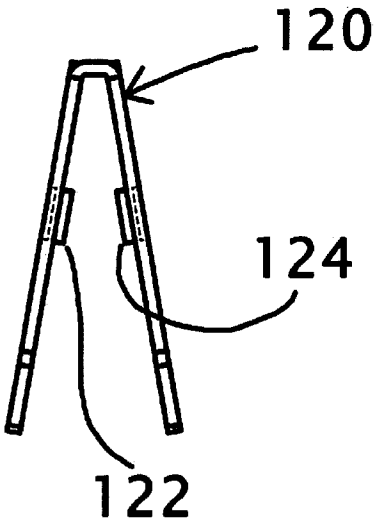
FIG. 11 is an end view of the semi-pierced embodiment of FIG. 9 in partial folded position.
Figure 12:
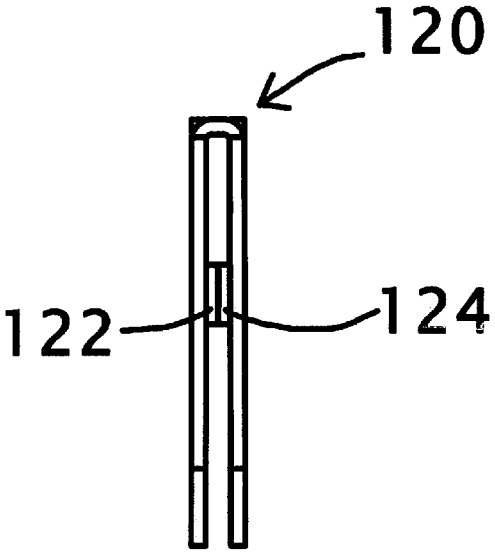
FIG. 12 is an end view of the semi-pierced embodiment of FIG. 9 in final folded position.
Figure 13:
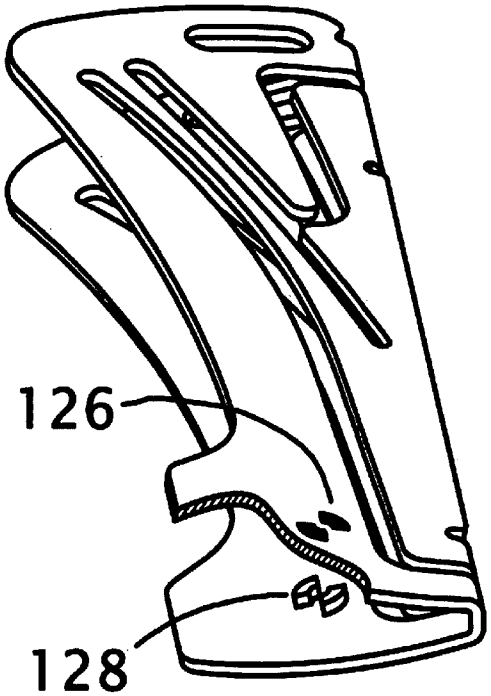
FIG. 13 is a perspective view of a handle blank for forming another alternate embodiment of the folding knife of FIG. 1 wherein the semi-piercing fine blanking technique is used to form the pivot structure with a notch.
Figure 14:
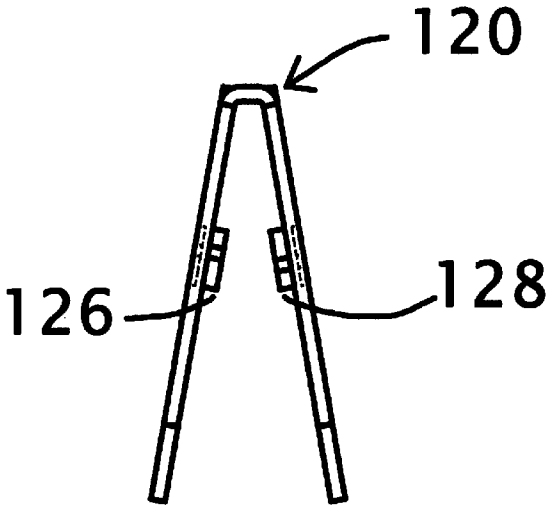
FIG. 14 is an end view of the semi-pierced embodiment of FIG. 13 in partial folded position.
Figure 15:
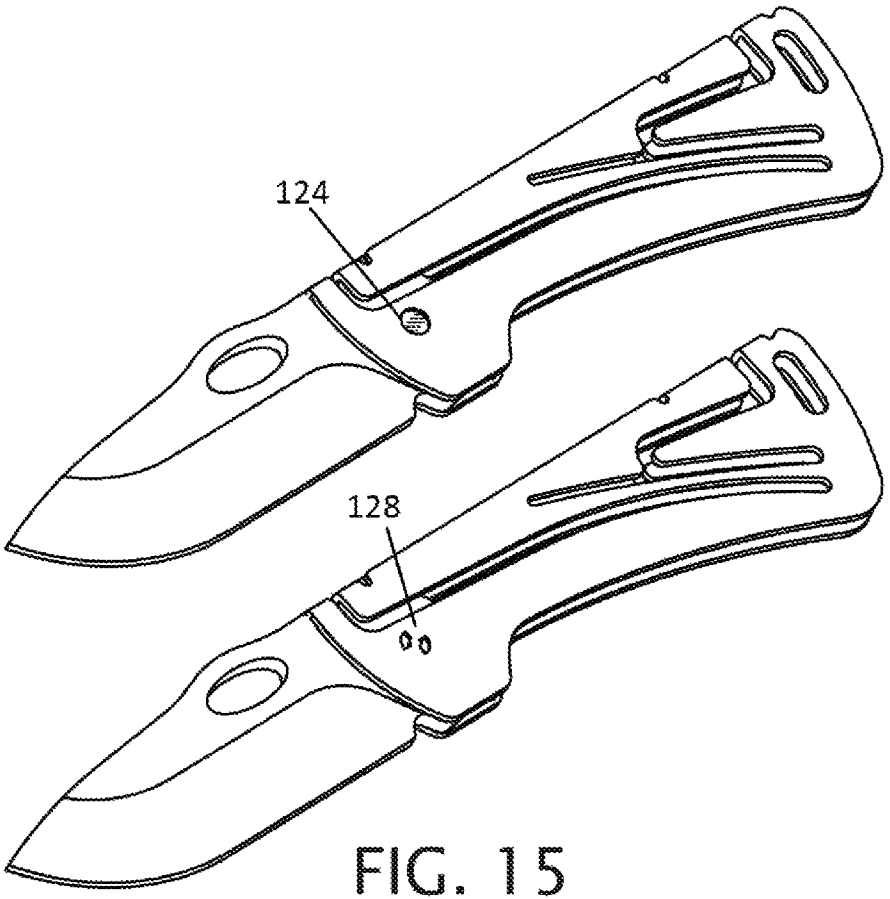
FIG. 15 is an elevated side view of the two alternative embodiments disclosed in FIGS. 9 and 13 as assembled with blade.

As shown in FIGS. 10, 11, and 13, a pivot structure comprising a first pin, or projection 122, and a second pin, or projection, 124 aligns to one another as the blank is folded. The first pin 122 extends laterally inwardly from one side of the handle and the second pin 124 extends laterally inwardly from the opposite side of the handle as the blank shown in FIG. 9 (or alternatively FIG. 13 for the notched version) is folded over. In the finished embodiment, the blade 14 at the pivot hole 19 is centered about the axis created by first pin 122 and second pin 124 (or first pin 126 and second pin 128 in the notched version shown in FIG. 13) thereby pivotally fixating the blade 14 to the handle 120 upon final forming. Once final forming is complete as shown in FIG. 12 without the blade 14 present, the pins 122, 124 form the pivot structure. Welding or chemical bonding of the pins 122 and 124 may increase strength under certain applications, but is not necessary under most pocket knife use.

As illustrated in FIGS. 9-15, the semi-pierced first and second pins 122 and 124 may be of desired shape and form that provide the pivotable structure connecting the blade 14 to the handle 120.

The foregoing description of the preferred embodiment of the present invention has been presented for the purpose of illustration and description. It is not intended to be exhaustive or to limit the invention to the precise form disclosed. Many modifications and variations are possible in light of the above teachings. For instance, instead of two semi-pierced extrusions, two metal tabs could be folded out of the handle material to mate up in a similar manner to provide the necessary pivot feature provided by the semi-pierce. It is intended that the scope of the present invention not be limited by this detailed description, but by the claims and the equivalents to the claims appended hereto.

I claim:

1. A folding lock back knife comprising:

a blade having a tip and a tang portion, the tang portion having a first tang notch, and a pivot hole;

a two sided handle of unitary construction formed from a continuous piece of metal having an integral locking mechanism and end portion of spine;

a pivot structure pivotally mounting the blade to the handle allowing the blade to pivot between open and closed positions;

the end portion of spine located to engage the first tang notch stopping the blade from rotating past the open position;

the locking mechanism having a locking bar integral with a support arm continuously formed between a locking end portion and a pressure pad end constructed and arranged to lock the blade in relation to the handle when the locking end portion engages the first tang notch defining the open position and unlocks the blade in relation to the handle when force is applied in a direction of the handle at the pressure pad end thereby disengaging the locking end portion from the first tang notch.

2. The folding lock back knife of claim 1, in which the continuous piece of metal is a sheet of metal in thickness of at least forty thousandths of an inch.

3. The folding lock back knife of claim 1, in which the pivot structure consists of a pivot screw and a pivot pin.

4. The folding lock back knife of claim 1, wherein the pivot structure is integral with the handle and consists of a semi-pierced first pin and a semi-pierced second pin.

5. The folding lock knife of claim 1, in which the tang portion has a second tang notch constructed and arranged to lock the blade in relation to the handle when the locking end portion engages the second tang notch defining the closed position and unlocks the blade in relation to the handle when force is applied in the direction of the handle at the pressure pad end thereby disengaging the locking end portion from the second tang notch.

6. A folding lock back knife comprising:

a blade having a tip and a tang portion, the tang portion having a first tang notch, and a pivot hole;

a one sided handle of unitary construction formed from a continuous piece of metal having an integral locking mechanism and end portion of spine;

a pivot structure pivotally mounting the blade to the handle allowing the blade to pivot between open and closed positions;

the end portion of spine located to engage the first tang notch stopping the blade from rotating past the open position;

the locking mechanism having a locking bar integral with a support arm continuously formed between a locking end portion and a pressure pad end constructed and arranged to lock the blade in relation to the handle when the locking end portion engages the first tang notch defining the open position and unlocks the blade in relation to the handle when force is applied in a direction of the handle at the pressure pad end thereby disengaging the locking end portion from the first tang notch.

7. The folding lock back knife of claim 6 wherein the continuous piece of metal is a sheet of metal in thickness of at least forty thousandths of an inch.

8. The folding lock back knife of claim 6, in which the pivot structure consists of a pivot screw and a pivot pin.

9. The folding lock knife of claim 6, in which the tang portion has a second tang notch constructed and arranged to lock the blade in relation to the handle when the locking end portion engages the second tang notch defining the closed position and unlocks the blade in relation to the handle when force is applied in the direction of the handle at the pressure pad end thereby disengaging the locking end portion from the second tang notch.

* * * * *